US010897927B2

(12) United States Patent
Deurloo et al.

(10) Patent No.: US 10,897,927 B2
(45) Date of Patent: Jan. 26, 2021

(54) NONLINEAR FLEXIBLE MAGNETIC FILTER ELEMENT

(71) Applicant: Frog Creek Partners, LLC, Casper, WY (US)

(72) Inventors: Brian Deurloo, Casper, WY (US); Terry Lowe, Golden, CO (US)

(73) Assignee: FROG CREEK PARTNERS, LLC, Casper, WY (US)

( * ) Notice: Subject to any disclaimer, the term of this patent is extended or adjusted under 35 U.S.C. 154(b) by 224 days.

(21) Appl. No.: 15/870,428

(22) Filed: Jan. 12, 2018

(65) Prior Publication Data

US 2018/0199620 A1 Jul. 19, 2018

Related U.S. Application Data

(60) Provisional application No. 62/446,794, filed on Jan. 16, 2017.

(51) Int. Cl.

| | |
|---|---|
| ***A24D 3/04*** | (2006.01) |
| ***A24D 3/06*** | (2006.01) |
| ***A24D 3/16*** | (2006.01) |
| ***A24F 13/22*** | (2006.01) |
| ***A24D 3/10*** | (2006.01) |

(52) U.S. Cl.

CPC ..... *A24D 3/046* (2013.01); *A24D 3/068* (2013.01); *A24D 3/10* (2013.01); *A24D 3/16* (2013.01); *A24F 13/22* (2013.01)

(58) Field of Classification Search

CPC ..... A24D 3/046; A24D 3/048; A24D 3/061

See application file for complete search history.

(56) References Cited

U.S. PATENT DOCUMENTS

| | | | | |
|---|---|---|---|---|
| 2,192,569 | A | 3/1940 | Williams | |
| 3,461,880 | A | 8/1969 | Stubblefield | |
| 3,613,215 | A | 10/1971 | Uhl | |
| 4,117,064 | A | 9/1978 | Mathe et al. | |
| 4,176,054 | A | 11/1979 | Kelley | |
| 4,258,730 | A | 3/1981 | Tsukamoto | |
| 4,260,523 | A | 4/1981 | Tsukamoto | |
| 2004/0111287 | A1 | 6/2004 | Singh | |
| 2005/0236005 | A1* | 10/2005 | Bears | A24F 15/18 131/235.1 |

(Continued)

FOREIGN PATENT DOCUMENTS

| | | | |
|---|---|---|---|
| CN | 2244820 | Y | 1/1997 |
| CN | 2810216 | Y | 8/2006 |

(Continued)

OTHER PUBLICATIONS

E. Slaughter et al., "Toxicity of Cigarette Butts, and Their Chemical Components, to Marine and Freshwater Fish," Tobacco Control 2011; 20:i25ei29. Doi:10.1136/tc.2010.040170.

(Continued)

*Primary Examiner* — Michael H. Wilson
*Assistant Examiner* — Katherine A Will
(74) *Attorney, Agent, or Firm* — Pate Baird, PLLC

(57) ABSTRACT

A magnetizable object within a smoking article or tobacco product that has magnetic properties optimized to enable efficient magnetic retrieval of the smoking article from the environment in a manner that is independent of spatial orientation of the article with respect to the magnetic field.

16 Claims, 11 Drawing Sheets

(56) References Cited

U.S. PATENT DOCUMENTS

| | | | | |
|---|---|---|---|---|
| 2006/0272663 | A1 | 12/2006 | Dube et al. | |
| 2007/0235049 | A1 | 10/2007 | Gedevanishvili et al. | |
| 2008/0035163 | A1 | 2/2008 | Cheyene | |
| 2010/0059074 | A1 | 3/2010 | Brantley et al. | |
| 2011/0305888 | A1 | 12/2011 | Lafebere | |
| 2012/0168329 | A1* | 7/2012 | Berggren | A24F 23/04 206/256 |
| 2012/0318286 | A1 | 12/2012 | Lisauskas et al. | |
| 2014/0150783 | A1 | 6/2014 | Liu | |
| 2014/0216450 | A1 | 8/2014 | Liu | |
| 2014/0360518 | A1 | 12/2014 | Besso | |
| 2015/0040931 | A1 | 2/2015 | Lisan et al. | |

FOREIGN PATENT DOCUMENTS

| | | | |
|---|---|---|---|
| CN | 203152473 | U | 8/2013 |
| EP | 1 084 631 | A1 | 3/2001 |
| WO | WO 2015/067372 | A1 | 5/2015 |

OTHER PUBLICATIONS

JL Pauly et al., "Cigarettes with Defective Filters Marketed for 40 Years," Tobacco Control 2002; 11:i51-i61 doi:10.1136/tc.11suppl_1.i51.

Kathleen M. Register, "Cigarette Butts as Litter—Toxic as Well as Ugly," (Online) Longwood University, (Issued on Aug. 2000) < http://www.longwood.edu/cleanva/ciglitterarticle.htm> (Seven (7) Pages).

International Search Report (PCT/ISA/210) issued in PCT Application No. PCT/US2018/013548 dated Mar. 28, 2018 (three (3) pages).

Written Opinion (PCT/ISA/237) issued in PCT Application No. PCT/US2018/013548 dated Mar. 28, 2018 (six (6) pages).

* cited by examiner

| Iron Alloy Material Properties | | | | | | | | |
|---|---|---|---|---|---|---|---|---|
| Material Name | Composition | Initial Permeability $\mu_i$ | Flux Density Tesla $B_s$ | Curie Temp. °C | dc, Coercive Force, Hc Oersteds | Density grams/cm³ δ | Weight Factor x | Typical B-H Loop Figures |
| Silicon | 3% Si<br>97% Fe | 1.5 K | 1.5-1.8 | 750 | 0.4-0.6 | 7.63 | 1.000 | (2-3) |
| Supermendur* | 49% Co<br>49% Fe<br>2% V | 0.8 K | 1.9-2.2 | 940 | 0.15-0.35 | 8.15 | 1.068 | (2-4) |
| Orthonol | 50% Ni<br>50% Fe | 2 K | 1.42-1.58 | 500 | 0.1-0.2 | 8.24 | 1.080 | (2-5) |
| Permalloy | 79% Ni<br>17% Fe<br>4% Mo | 12 K-100 K | 0.66-0.82 | 460 | 0.02-0.04 | 8.73 | 1.144 | (2-6) |
| Supermalloy | 78% Ni<br>17% Fe<br>5% Mo | 10 K-50 K | 0.65-0.82 | 460 | 0.003-0.008 | 8.76 | 1.148 | (2-7) |

* Field Annual.

x Silicon has unity weight factor.

FIGURE 39

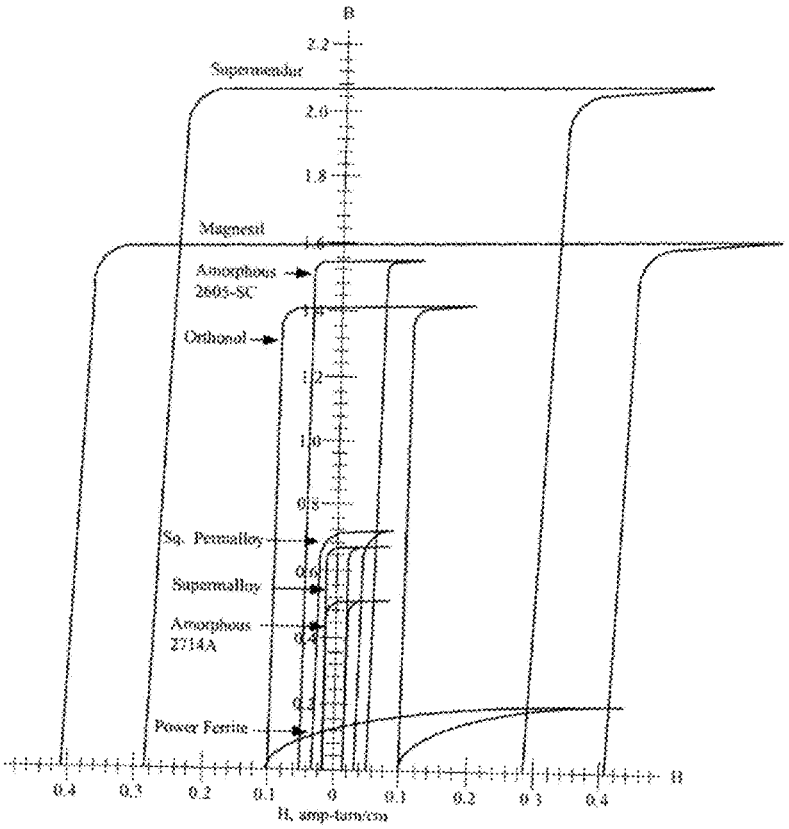

FIGURE 40

NONLINEAR FLEXIBLE MAGNETIC FILTER ELEMENT

CROSS REFERENCE TO RELATED APPLICATIONS

This application claims priority to and the benefit of U.S. Provisional Application No. 62/446,794, filed Jan. 16, 2017, which is incorporated herein by reference in its entirety.

BACKGROUND

Discarded cigarette filters, or commonly known as butts, are the most commonly discarded waste product worldwide. One may argue that a single cigarette butt would not inflict serious environmental damage, but the cumulative effect of trillions of cigarette butts littered yearly to the environment presents a significant threat to the ecosystem. In 2007 there were over 1.35 trillion filtered cigarettes manufactured in the United States and more than 360 billion cigarettes were consumed in the US (USDA 2007). In 2014 over 5,800,000,000,000 (5.8 trillion) cigarettes were produced worldwide to satisfy the needs of over a billion smokers. Statisticians estimate that approximately nine trillion cigarettes will be manufactured in the world by 2025. It is estimated that about 80 percent of the smoked cigarettes (4.6 trillion in 2014) are thrown into the environment as litter every year. This toxic waste creates an enormous environmental, health, and economic burden.

Per a 2010 research paper by E. Slaughter et al at San Diego State University and Nautilus Environmental, the mortality rate of a fish minnow population, whether freshwater species or saltwater species, is five out of every 10 minnows die within four days when a single smoked cigarette butt with remnant tobacco is placed in one liter of water with the fish. It is not difficult to assume that cigarette butt litter harms insect populations too since neonicotinoids can be used as an insecticide.

Research indicates that smoking is bad for a person's health. Most people think that it is just the mainstream tobacco smoke that is detrimental to a human's lungs. This is not entirely true. Approximately 90% of the 5.6 trillion cigarettes sold in 2014 had a filter. Cigarette filters may contain between 12,000 and 30,000 plastic-like cellulose acetate fibers. Cigarette filters may also contain many other materials including carbon particles or charcoal. During the process of making a cigarette filter in a high-speed manufacturing process, fragments of cellulose acetate are exposed or created near the end face of the filter when the filter is cut to its desired length. Nearly all cigarette filters have these cellulose acetate fragments near the end face. These fragments are referred to as "filter fall-out" when they are released from the filter and inhaled during the act of smoking a cigarette. The term "filter fall-out" was defined in 1985 laboratory protocols of Philip Morris, Inc. as "*loose fibers (or particles) that are drawn out of the filter during puffing of the cigarette*". There are recorded cases where a tar-saturated fragment of cellulose acetate (e.g., filter fall-out) becomes lodged in a smoker's lungs causing irreversible damage. These cellulose fibers colored brown by tar have been shown to resist degradation in laboratory mice. Doctor F. Adlkofer noted in his research that, "With high probability, the fibres which were seen by the authors in the lungs of smokers with lung cancer are in fact cellulose acetate fibres."

SUMMARY OF THE INVENTION

The present novel invention specifies a nonlinear magnetic filter element that can be incorporated in or to a smoking apparatus to enable magnetic retrieval of the littered smoking apparatus from the environment. The object may include a magnetizable material that is magnetically soft. Specifically, the magnetizable material may have a combination of magnetic properties that include low magnetic coercivity, high magnetic permeability, high saturation magnetic flux density in order to be best suited for retrieval using a magnetic field. One example of a magnetizable material that is suited for magnetic retrieval is a Supermalloy. This alloy includes 75% nickel, 20% iron, and 5% molybdenum. It has a low coercivity (0.008 amp/meter), high permeability (800,000 Newtons/Amp$^2$) (relative permeability of 8000), and saturation magnetization of 7 kilogauss. Ferritic stainless steel is also a suitable candidate for a magnetic material, but has a permeability of approximately 0.002 Newtons/Amp$^2$ (relative permeability $\mu/\mu_0$ of about 1500, where $\mu$ is the permeability of the material and $\mu_0$ is the permeability of free space). A flexible magnetic filter element can include a plurality of materials including the magnetic materials (and their relative magnetic properties) that are shown in FIG. 39. The magnetic response of these materials to applied field of strength H is shown in FIG. 40. The materials with the lowest coercivity (the narrowest B-H hysteresis loops) are best suited for magnetic pickup since they can be magnetized with the smallest magnitude of applied field. However, material with higher saturation magnetization will be suited for embodiments in which strength of applied field is not a limitation or the distance over which objects are to be attracted is small.

This invention introduces the novel concept of incorporating a nonlinear magnetizable element to a manufactured tobacco article or other tobacco related products, e.g., cigarette, cigarette filter, smokeless tobacco pouch, tobacco packaging (cellophane wrapper, carton, box, container, etc.), cigar, cigar tip (wood or plastic), etc., for means of magnetically reclaiming a littered smoking article from the environment. Regardless of the magnetic material selected for the magnetic element, it is the shape of the magnetic element that is critical. The need for a nonlinear shape of the magnetic element is because of the intrinsic anisotropy of the magnetic response of constituent magnetic materials combined with their intrinsic crystallographic anisotropy. This intrinsic anisotropy is a result of the processing methods by which materials are made into useful forms. Some degree of crystallographic orientations is invariably present in nearly all crystalline materials, especially in magnetic materials. Constituent grains within a material tend to align along specific crystallographic orientations during material fabrication by such methods as rolling, drawing, casting, and annealing. For polycrystalline materials with extremely high degrees of orientation, the net behavior is comparable to a single crystal. For example, the [110] direction is easiest to magnetize in iron crystals. When there is no magnetic field applied to a magnet material, individual magnetic domains within the material are randomly oriented in Cartesian space such that there is little or no net magnetic moment in the material. When a magnetic field is applied to a magnetizable material, the magnetic domains within the material attempt to align with the applied field. The degree and ease of this realignment depends upon crystal orientation with respect to the applied field. Since this orientation is fixed within the proposed magnetizable element, the level of magnetization within a magnetic element contained in a smoking article will depend on the orientation of the element with respect to the applied field for collecting the smoking article from the environment. Therefore, it is advantageous for the magnetizable element to have multiple orientations so that there is a range of orientations that are most readily magnetized to interact with an attracting magnet. The net result of having multiple orientations of the magnetizable element available is to reduce and even eliminate the dependence of collection efficiency of smoking articles and other tobacco products from their positional orientation with respect to any applied magnetic field. For example, a semi-circular wire-like element embedded in a cigarette filter presents a 180-degree range of orientations to an applied magnetic field such that one is assured that the magnitude of the attractive force does not depend significantly on the orientation of the cigarette filter as it rests within the environment.

An additional advantage of having a nonlinear object, rather than a linear object, within a smoking article is that it can be more securely anchored in the article. In contrast, a linear object embedded in a filter may more readily be inhaled by a smoker if the object is aligned with the longitudinal axis of the smoking article. It may also be more readily extracted from the filter during magnetic pick up, thus leaving the smoking object behind. Nonlinear embodiments which advantageously serve the dual purpose of being anchored more securely within and smoking article and assure high level of magnetizability are depicted in FIGS. 1 through 38.

According to one example of the present invention, the magnetizable material is a nonlinear shape but the embodiment may be in any shape and dimension. The magnetizable material may include one or more shapes including but not limited to letters, numbers, designs, logos, linear shapes, patterns, polygons, stars, animals, plants, fungi, etc. The magnetizable material can even be knotted one or more times.

The magnetizable material can be incorporated into a smoking article by a plurality of methods including but not limited to continuous feeding methods and discrete placement methods into the smoking article, tobacco article or packaging article. For example, the magnetizable material may be incorporated to a filter component or mouthpiece of a smoking article at the time of production. Alternatively, and in another example, a nonlinear magnetizable material can be applied to a smoking article or tobacco product with the use of spray. The magnetic material can be sprayed onto a smoking element and tobacco article at time of production, (with or without the use of adhesive) so it coats or partially coats one or more elements of a smoking article.

According to another example of the invention, a nonlinear magnetic filter element embodies an adhesive. A nonlinear flexible magnetic filter element can be incorporated to a smoking article or tobacco product with or without the use of an adhesive. An adhesive element can advantageously hold the magnetizable material in or on the smoking article. Furthermore, the adhesive can deter filter fallout from exiting the cigarette filter during the smoking process. A magnetizable material with adhesive embodiment can attach to a plurality of filter particles (e.g., filter fallout, carbon, charcoal, etc.) within a cigarette filter to help prevent the filter particles from dislodging from the smoking article during the smoking process and becoming lodged in a smoker's lungs.

During the process of producing, forming, or cutting a flexible nonlinear magnetizable material one may impart a contour to the magnetizable material for the added benefit of increased friction. For example, when cutting a foil or ribbon, one can cut the edges of the ribbon or foil so the edges scallop or bend. The scalloping effect can increase the surface area of the magnetizable material as well as increase its coefficient of friction thereby making it harder to dislodge from a cigarette filter during the smoking process or magnetic reclamation process. Contours may also be incorporated to any surface of the magnetizable material.

According to yet another example of the invention, a nonlinear magnetic filter element is flexible. The flexible nature of the invention is made in part by the physical and chemical attributes of the magnetizable material. Mainly it is the relative thinness of the flexible nonlinear magnetic filter element that allows it to be flexible. In one example embodiment, a magnetizable material incorporated to a smoking article or tobacco product is flexible. Flexibility is an important property of the embodiment so the feel of the tobacco article is similar to a tobacco article (e.g. cigarette, filter, cigar, smokeless tobacco pouch, packaging, etc) without a flexible nonlinear magnetic filter element embodiment. Moreover, a flexible element is important in the event an animal ingests a smoking article as to not puncture its internal organs. The magnetizable material can even be knotted on or more times.

The magnetizable material can be one or more wires, foils, ribbons, or combination thereof with varying thickness and dimension. Furthermore, the magnetizable material may be of the stainless sort and embody materials that deter oxidation. Moreover, the magnetizable material may embody a coating that for purposes including rust inhibitor, coloration, branding, flavorant, adhesiveness, marketing, visibility, identification, protectant, etc. The magnetizable material or its coating may be hypoallergenic, food safe, and tasteless as to not unduly affect the user.

The magnetizable material can be incorporated to other smoking like articles including electronic cigarette components and electronic cigarette component packaging for means of reclaiming these components from the environment if they are littered.

The magnetizable material can be incorporated to other associated tobacco products including but not limited to a smokeless tobacco pouch, cigar tip (of the wood or plastic type), and tobacco packaging material such as boxes, cartons, wrappers, cellophane, etc.

The magnetizable material may be treated physically or chemically to impart new characteristics. These treatments may include one or more acids, bases, enzymes, reactants, agents, chemicals, temperatures, laser, markings, pressure, etc.

BRIEF DESCRIPTION OF THE DRAWINGS

FIG. 39 is a chart including a plurality of materials and their relative magnetic properties in accordance with one or more aspects of the invention.

FIG. 40 is a graph illustrating the magnetic response of the materials of FIG. 39 in accordance with one or more aspects of the invention.

DETAILED DESCRIPTION OF EMBODIMENTS OF THE INVENTION

Figure 1:
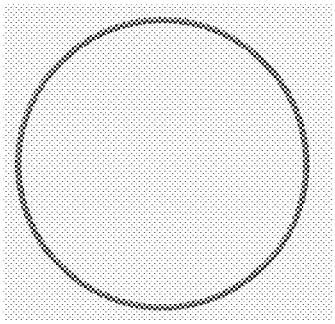
FIG. 1 is a schematic identifying a circular magnetizable ring element made of wire that can be incorporated into a smoking article or tobacco article in accordance with one or more aspects of the invention.
Figure 2:
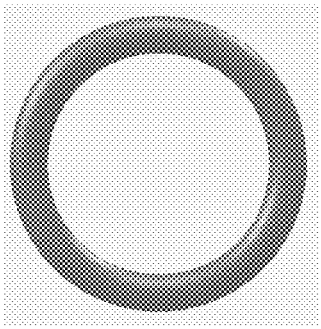
FIG. 2 is a schematic identifying a circular magnetizable ring element coated with at least one material that can be incorporated into a smoking article or tobacco article in accordance with one or more aspects of the invention.
Figure 3:
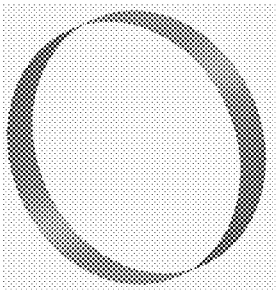
FIG. 3 is a schematic identifying a circular magnetizable ring element made of ribbon that can be incorporated into a smoking article or tobacco article in accordance with one or more aspects of the invention.

By way of example, the embodiment shown in FIG. 1 is a configuration that offers a plurality of orientations with respect to an external magnetic field. FIG. 1 denotes a ring-like structure made from magnetizable wire. FIG. 2 shows a magnetic ring that is coated with a material which makes the periphery ring have a larger diameter. The ring and wire can be of any dimension and the wire can be hollow or solid. FIG. 3 denotes a ring made of a magnetizable ribbon.

Figure 4:
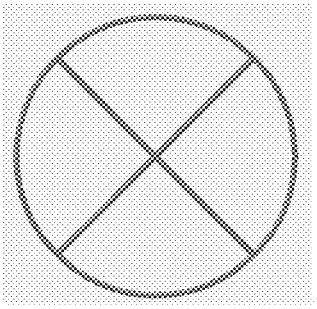
FIG. 4 is a schematic identifying a circular magnetizable element made of wire, foil or ribbon with orthogonal cross supports that can be incorporated into a smoking article or tobacco article in accordance with one or more aspects of the invention.

The embodiment in FIG. 4 is similar to the embodiment in FIG. 1, but with additional diametral supports to enhance the rigidity of the structure. This embodiment may be made from wire, foil, and/or ribbon and have one or more diametral supports.

Figure 5:
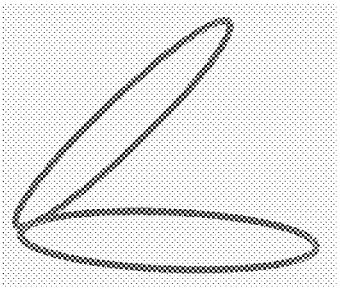
FIG. 5 is a schematic identifying a two obliquely oriented circular magnetizable attached ring elements made of wire or ribbon that can be incorporated into a smoking article or tobacco article in accordance with one or more aspects of the invention.

The embodiment in FIG. 5 incorporates the simplicity of the circular embodiment in FIG. 1, but with the additional benefit of having a point of joining between two or more rings that can act as a torsional spring. The two rings can be compressed slightly to cause the dimensions of the object to be less than the diametral dimensions of a containing smoking article. When the compression is released, the torsional force of expansion of the angle between the two rings or disks can provide additional force to anchor the magnetizable object within the smoking article. The angle between the axes of the two rings or disks can be between 0 degree and 180 degrees. This embodiment may be made from wire, ribbon, or foil. FIG. 5 shows two rings at a 45-degree angle to each other.

Figure 6:
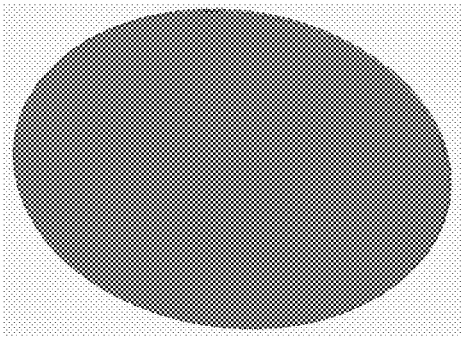
FIG. 6 is a schematic identifying an elliptical magnetizable disk element made of foil or ribbon that can be incorporated into a smoking article or tobacco article in accordance with one or more aspects of the invention.

FIG. 6 shows a single elliptical disk made of magnetizable ribbon or foil. A disk can be wholly or partially coated with one or more materials. Furthermore, the disk can embody further embodiments including contours, ridges, nonmagnetic material, holes, etc.

Figure 7:
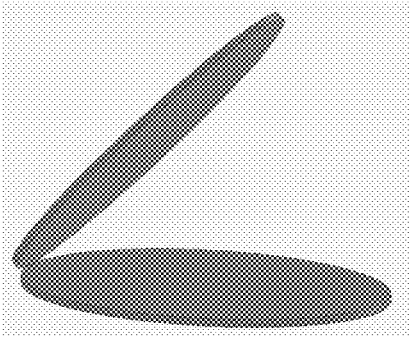
FIG. 7 is a schematic identifying a two obliquely oriented attached elliptical magnetizable disk-like elements made of foil or ribbon that can be incorporated into a smoking article or tobacco article in accordance with one or more aspects of the invention.

The embodiment in FIG. 7 is an oblique view of two elliptical disk configurations joined at one point. Similar to FIG. 5, the angle between the axes of the two-elliptical disk configurations could be between 1 degree and 180 degrees. FIG. 7 shows the disks at an angle of approximately 45 degrees. The structure can be fabricated from magnetizable ribbon or foil. At least one disk can be wholly or partially coated with one or more materials.

Figure 8:
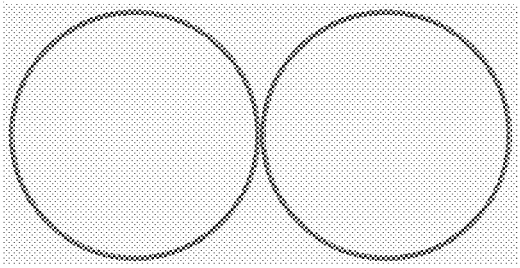
FIG. 8 is a schematic identifying a two circular magnetizable attached ring elements made of wire or ribbon that can be incorporated into a smoking article or tobacco article in accordance with one or more aspects of the invention.

FIG. 8 shows two rings joined at one point and at an angle of 180 degrees.

Figure 9:
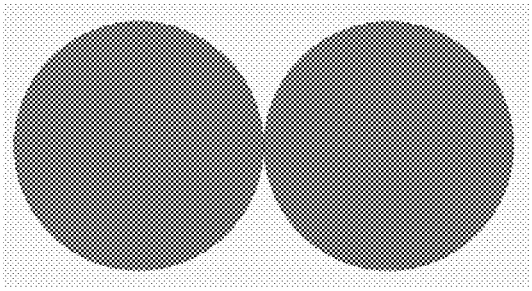
FIG. 9 is a schematic identifying two circular magnetizable attached disk elements made of foil or ribbon that can be incorporated into a smoking article or tobacco article in accordance with one or more aspects of the invention.

Similar to FIG. 8, FIG. 9 shows two circular disks at a 180-degree angle to each other and joined by at least one point.

Figure 10:
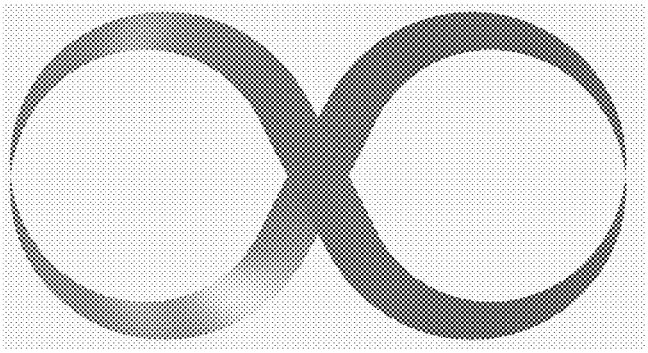
FIG. 10 is a schematic of FIG. 8 made of magnetizable ribbon that can be incorporated into a smoking article or tobacco article in accordance with one or more aspects of the invention.

FIG. 10 shows a ribbon formed into a shape similar to the one shown in FIG. 8. When the shape in FIG. 8 is created from a ribbon, the normal points to the surface of the ribbon and can be perpendicular to the plane shown in FIG. 8, or oriented such that all normal point inwards to the center of each circular region. The embodiment shown in FIG. 8 can be symmetrical or asymmetrical.

Figure 11:
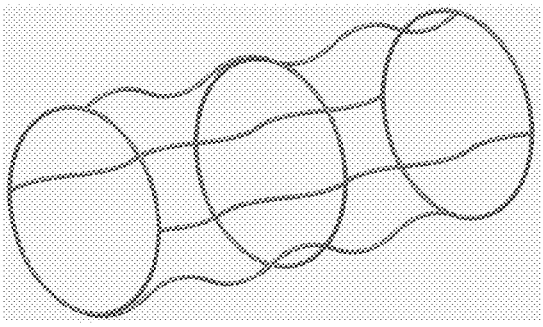
FIG. 11 is a schematic identifying a series of circular rings interconnected by corrugated wires that can be incorporated into a smoking article or tobacco article in accordance with one or more aspects of the invention.

The embodiment in FIG. 11 is essentially a tubular lattice that includes multiple rings of wire or ribbon spaced along the longitudinal axis of a smoking article. The rings are secured by longitudinal wires, which themselves are corrugated in order to offer a range of magnetic material orientations for optimum magnetic retrieval.

Figure 12:
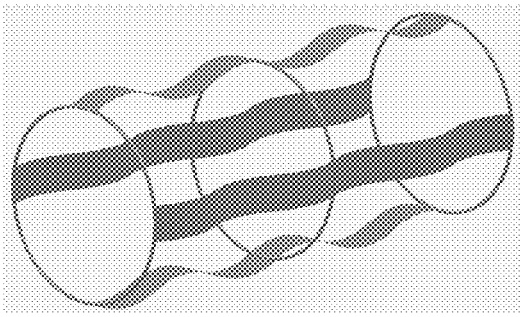
FIG. 12 is a schematic identifying a series of circular rings interconnected by flexible nonlinear ribbons that can be incorporated into a smoking article or tobacco article in accordance with one or more aspects of the invention.

The embodiment in FIG. 12 incorporates the simplicity of the tubular lattice in FIG. 11, but with the additional benefit of the magnetizable rings being secured by at least one longitudinal ribbon of magnetizable, or non-magnetizable material. This particular illustration shows four ribbons connecting 3 rings where the normal of the rings is approximately parallel to the longitudinal ribbon. Alternatively, one or more rings can be connected to one or more ribbons or wires where the normal of the rings is perpendicular to the longitudinal connector and the diameter of the ring is approximately parallel to the connecting ribbon(s) or wire(s).

Figure 13:
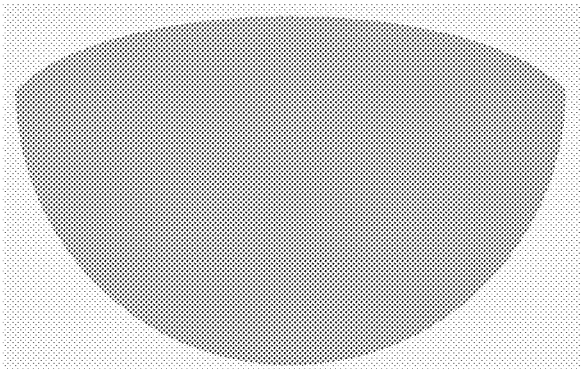
FIG. 13 is a schematic identifying a semicircle-like magnetizable element made of foil or ribbon that resembles a gibbous moon that can be incorporated into a smoking article or tobacco article in accordance with one or more aspects of the invention.
Figure 14:
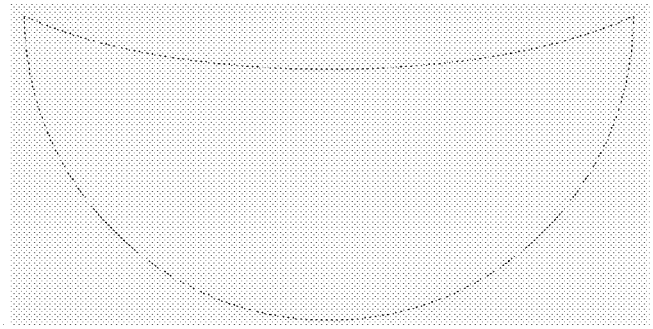
FIG. 14 is a schematic identifying a semicircle-like magnetizable element made of wire that resembles a crescent moon that can be incorporated into a smoking article or tobacco article in accordance with one or more aspects of the invention.
Figure 15:
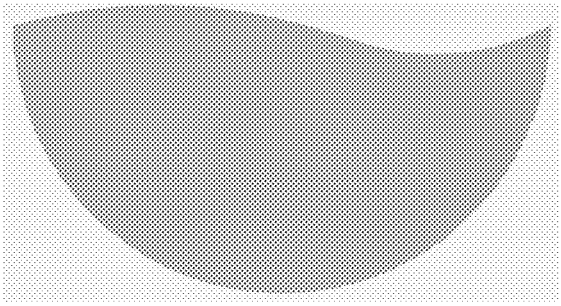
FIG. 15 is a schematic identifying a semicircle-like magnetizable element made of foil or ribbon that can be incorporated into a smoking article or tobacco article in accordance with one or more aspects of the invention.

The embodiments shown in FIGS. 13, 14, and 15 each shows a simple semicircle configuration where a nonlinear line connects two ends of the semicircle. The structure can be fabricated from wire, ribbon, or foil.

Figure 16:
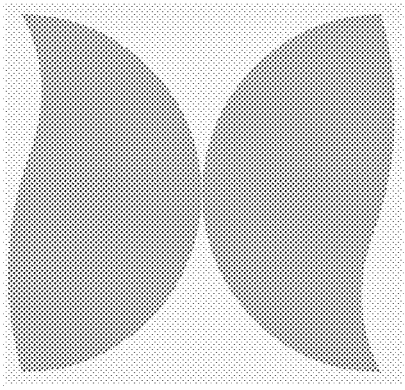
FIG. 16 is a schematic identifying a two connected semicircle-like magnetizable elements made of foil or ribbon that can be incorporated into a smoking article or tobacco article in accordance with one or more aspects of the invention.

The embodiment in FIG. 16 incorporates the simplicity of the semicircular-like embodiment in FIG. 15, but with the additional benefit of having a point joining two semicircular-like shapes.

Figure 17:
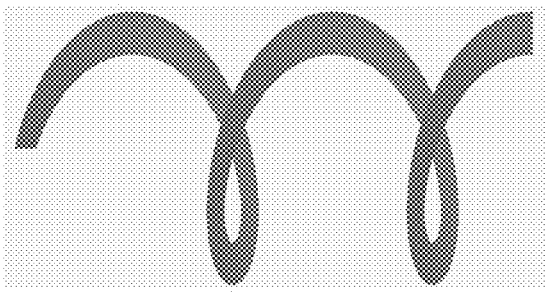
FIG. 17 is a schematic identifying a magnetizable ribbon formed into a helix (e.g., spring) shape that can be incorporated into a smoking article or tobacco article in accordance with one or more aspects of the invention.

The embodiment in FIG. 17 incorporates the simplicity of a helix or spring configuration where the nonlinear magnetizable element can be wrapped around or within a smoking article. FIG. 17 is a helix made from magnetizable ribbon.

Figure 18:
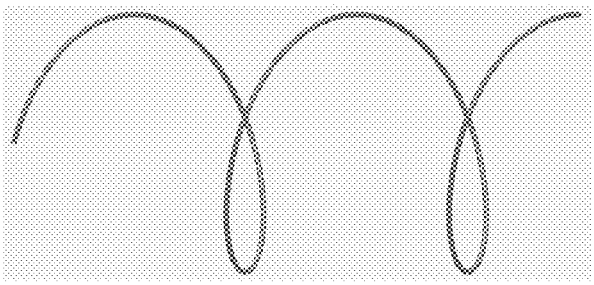
FIG. 18 is a schematic identifying a magnetizable wire formed into a helix shape that can be incorporated into a smoking article or tobacco article in accordance with one or more aspects of the invention.

FIG. 18 is a helix made from magnetizable wire.

Figure 19:
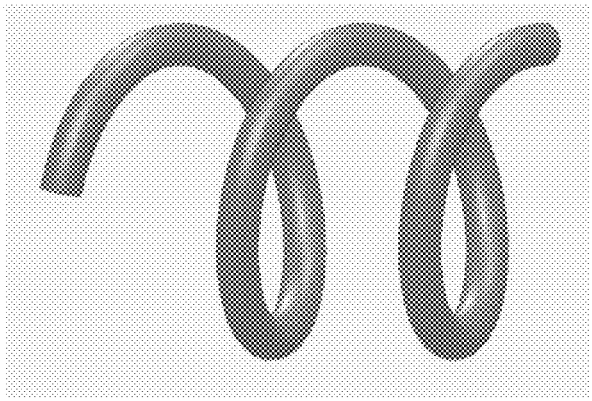
FIG. 19 is a schematic identifying a magnetizable wire formed into a helix shape coated with at least one material that can be incorporated into a smoking article or tobacco article in accordance with one or more aspects of the invention.

FIG. 19 is a magnetizable material that is coated with one or more magnetic or nonmagnetic materials. The helix can fully or partially make one or more revolutions around an axis. A partial radius helix would create a compressible spring-like element. Conceivably one can produce a double helix magnetizable element configuration as well. This element could be made of a nonlinear magnetizable wire or ribbon. The helix shape can be stretched or compressed to form varying helix shapes and dimensions best suited for application to a smoking article.

Figure 20:
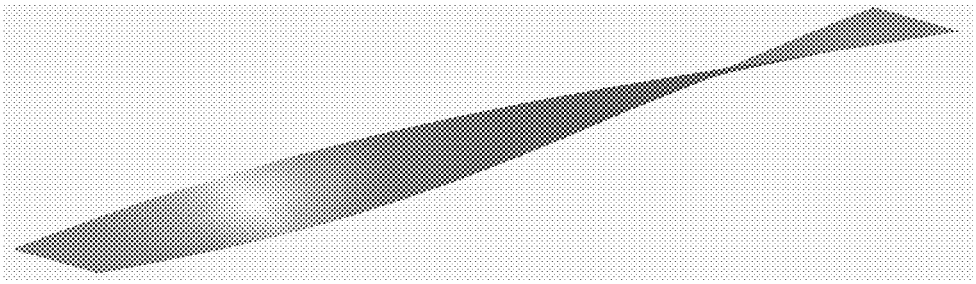
FIG. 20 is a schematic of a nonlinear flexible magnetizable ribbon that can be incorporated into a smoking article or tobacco article in accordance with one or more aspects of the invention.

The embodiment of FIG. 20 shows a nonlinear magnetizable material made from magnetizable foil or ribbon. The advantage of this embodiment is the relatively simple incorporation of at least one nonlinear flexible magnetizable material into a smoking article at time of production. The ribbon can be continuously fed from a spool into the filter element of a cigarette during the formation process and cut to length as the cigarette filter element is cut to length. The nonlinear and flexible nature of the embodiment can allow the magnetizable material to conform with the cigarette filter material (e.g., paper, cellulose acetate, etc.). Adhesive can be applied to the embodiment in FIG. 20 to enhance the ability of the magnetizable material to stay affixed within or on the cigarette filter element and perhaps prevent some filter fallout. Furthermore, the embodiment of FIG. 20 can be incorporated to, or within the pouch of a smokeless tobacco article allowing for magnetic reclamation.

Figure 21:
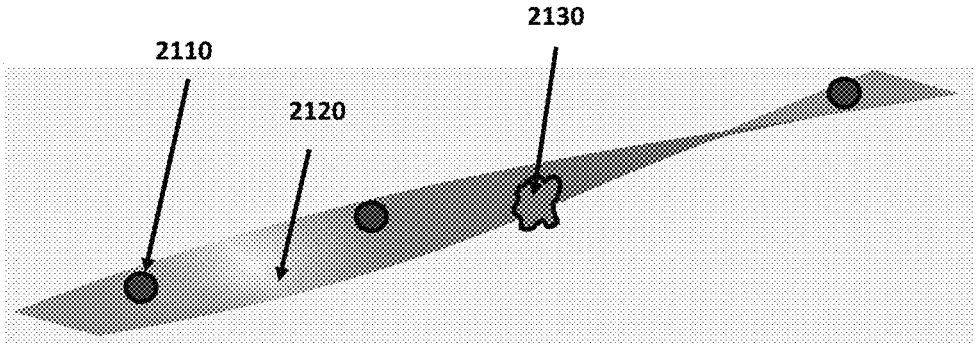
FIG. 21 is a schematic of a nonlinear flexible magnetizable ribbon with material adhered to the ribbon for incorporating into a smoking article or tobacco article in accordance with one or more aspects of the invention.

The embodiment of FIG. 21 incorporates the simplicity of FIG. 20 but with the added benefit of the magnetizable ribbon 2120 acting as a platform for attachment of a plurality of other embodiments or materials. For example, small balls 2110 or amorphous elements 2130 of a magnetic or non-magnetic sort can be adhered to the ribbon as shown in FIG. 21 and incorporated to a cigarette element or smokeless tobacco pouch. Furthermore, at time of production the ribbon can be wholly or partially coated with one or more materials that enhance or decrease the flavor, smokability, extinguishability, magnetic retrievability, filtration capability, toxicity, appearance, air flow, flexibility, malleability, strength, workability, traceability, and functionality of the magnetizable material incorporated to a tobacco product or packaging. Conceivably the magnetic material of FIG. 21 can be sprayed, treated, or coated with a plurality of materials prior to incorporating the magnetic material within a smoking article or other tobacco product.

Figure 22:
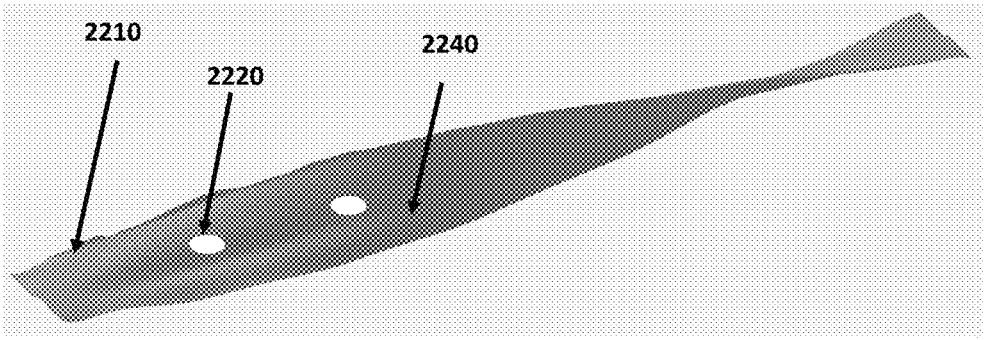
FIG. 22 is a schematic of a nonlinear flexible magnetizable ribbon with contoured (scalloped) edges and holes that can be incorporated into a smoking article or tobacco article in accordance with one or more aspects of the invention.

The magnetizable material embodiment 2240 in FIG. 22 incorporates the simplicity of the magnetizable ribbon embodiment in FIG. 20, but with the additional benefit of having contours 2210 around the edges of the shape to act as an additional frictional element. The frictional element can be imparted on the magnetizable material when it is cut thereby creating waves or scalloping along one or more edges. Additionally, the rough edges of the ribbon or foil can help hold the magnetizable material within a cigarette filter to prevent dislodgment during the act of smoking or magnetic reclamation. Moreover, FIG. 22 shows the addition of one or more holes 2220 within the magnetizable material which could advantageously contribute an element of friction or pathways for material or gas flow. FIG. 22 may or may not embody holes.

Figure 23:
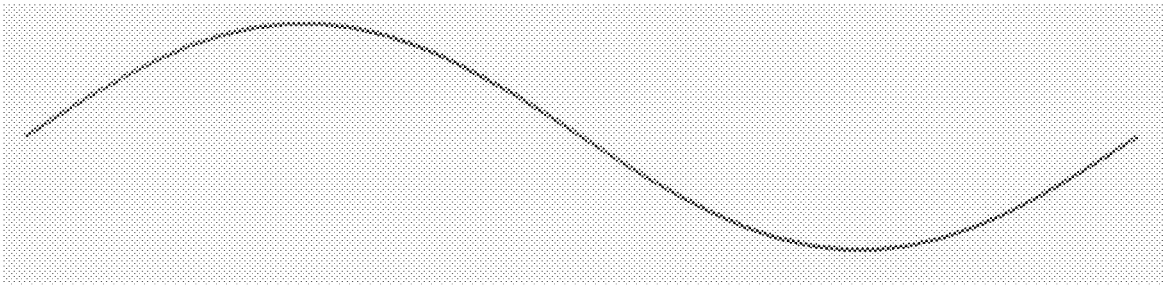
FIG. 23 is a schematic of a nonlinear flexible magnetizable wire that can be incorporated into a smoking article or tobacco article in accordance with one or more aspects of the invention.

FIG. 23 shows a flexible nonlinear magnetizable wire that can be incorporated to a cigarette element or smokeless tobacco pouch. One or more of these flexible nonlinear magnetizable wires can be incorporated to said tobacco product or packaging for the purpose of magnetic reclamation. The advantage of this embodiment is the relatively simple incorporation of a nonlinear flexible magnetizable material into a smoking article at time of production. The nonlinear wire can be continuously fed from a spool into the filter element of a cigarette during the production process and easily cut to length as the cigarette filter element is cut to length. The nonlinear and flexible nature of the embodiment can allow the magnetizable material to conform with the cigarette filter material (e.g., paper, cellulose acetate, etc.). Adhesive can be applied to the embodiment in FIG. 23 to enhance the ability of the magnetizable material to stay affixed within or on the cigarette filter element.

Figure 24:
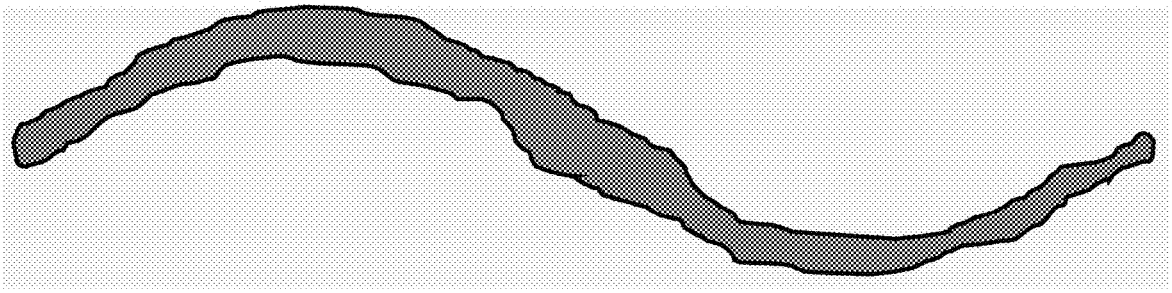
FIG. 24 is a schematic of a nonlinear flexible magnetizable wire with nonlinear coating that can be incorporated into a smoking article or tobacco article in accordance with one or more aspects of the invention.

FIG. 24 shows a flexible nonlinear magnetizable wire with one or more coatings.

Figure 25:
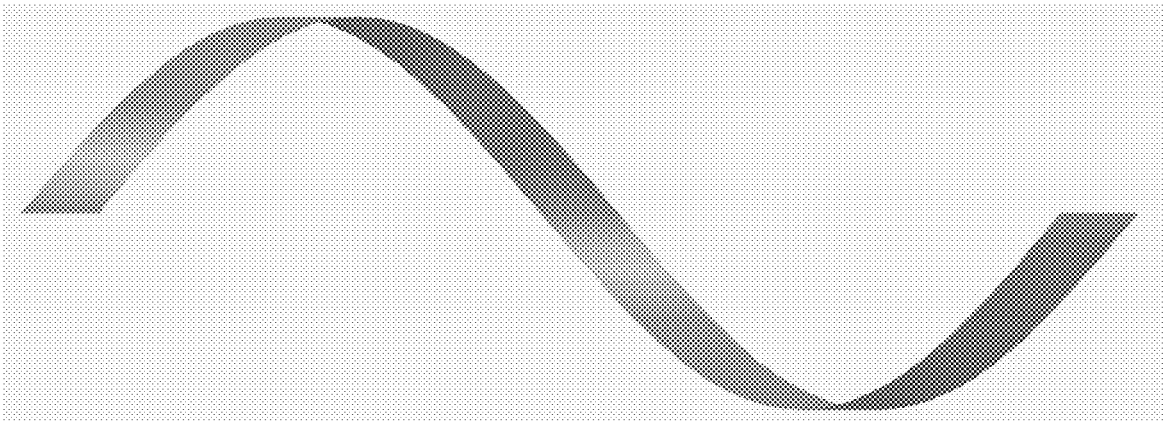
FIG. 25 is a schematic of a nonlinear flexible magnetizable ribbon that can be incorporated into a smoking article or tobacco article in accordance with one or more aspects of the invention.

FIG. 25 shows a flexible nonlinear magnetizable ribbon that can be incorporated to a smoking article, smokeless tobacco pouch, and/or tobacco packaging.

Figure 26:
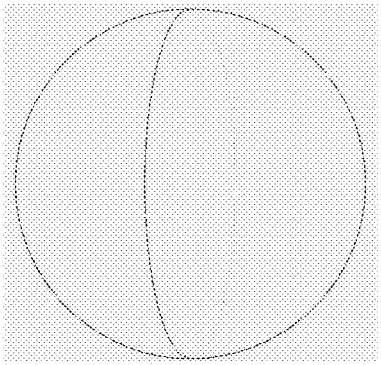
FIG. 26 is a schematic of a two nonlinear flexible magnetizable wires shaped into a sphere that can be incorporated into a smoking article or tobacco article in accordance with one or more aspects of the invention.

FIG. 26 shows two nonlinear magnetizable wires formed into a sphere where the wires are joined to each other at least once.

Figure 27:
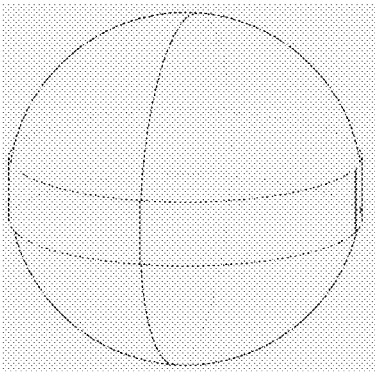
FIG. 27 is a schematic of a two nonlinear flexible magnetizable wires shaped into a sphere with a magnetizable ribbon wrapped around the perimeter that can be incorporated into a smoking article or tobacco article in accordance with one or more aspects of the invention.

FIG. 27 shows the two magnetizable wires in a spherical shape from FIG. 26 with the added embodiment of a magnetizable ribbon placed around the circumference of the sphere.

Figure 28:
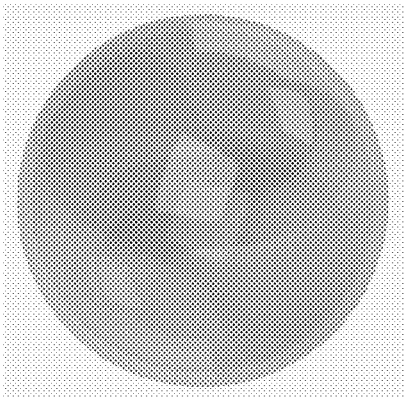
FIG. 28 is a schematic identifying a magnetizable material formed into a sphere that can be incorporated into a smoking article or tobacco product in accordance with one or more aspects of the invention.

The embodiment in FIG. 28 shows a simple sphere (or ball) configuration of magnetizable material. The sphere in FIG. 28 is a solid sphere made of magnetizable material. The sphere may be flexible or rigid and also take on the shape of a spheroid. One or more of the nonlinear magnetizable sphere embodiments in FIGS. 28, 29, and 30 may be incorporated to a smoking article or smokeless tobacco pouch.

Figure 29:
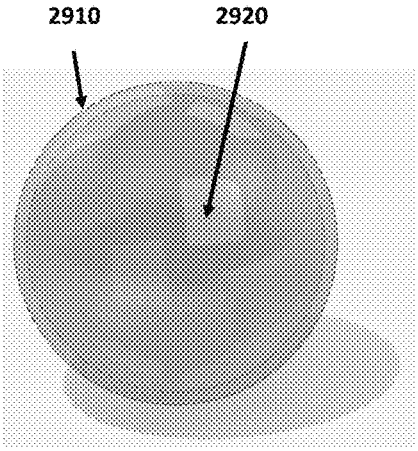
FIG. 29 is a schematic identifying a magnetizable material formed into a sphere that is hollow or filled with a material. The sphere can be incorporated into a smoking article or tobacco product in accordance with one or more aspects of the invention.

The embodiment of FIG. 29 shows the magnetizable material walls 2910 of a sphere encapsulating a space or material 2920 within the sphere. The inside of the sphere may be hollow or contain one or more elements. The sphere with magnetizable material may embody a plurality of elements including, for example, a flavorant, filtration media, buoyancy element, chemical, nutrient, liquid, gas, solid, etc. The walls of the sphere may be breakable with applied force causing the contents (if any) to release. The sphere may also be unbreakable or nearly unbreakable. The magnetizable nonlinear walls 2910 may be coated with one or more materials.

Figure 30:
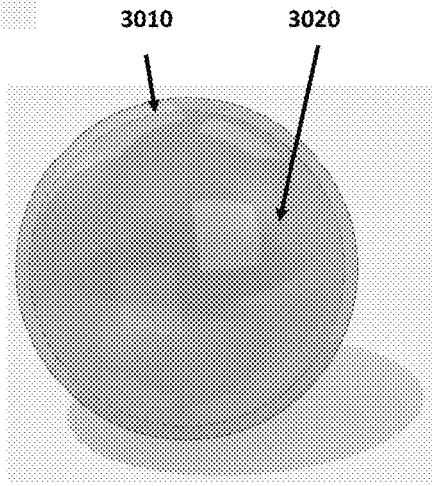
FIG. 30 is a schematic identifying a magnetizable material formed into a sphere that is coated with at least one material and can be incorporated into a smoking article or tobacco product in accordance with one or more aspects of the invention.

The embodiment of FIG. 30 shows a magnetizable material sphere 3020 encapsulated partially or wholly with one or more materials 3010.

Figure 31:
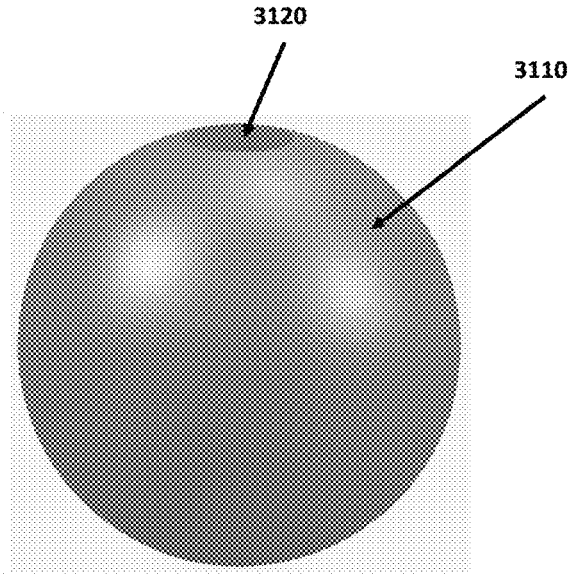
FIG. 31 is a schematic identifying a magnetizable material formed into a sphere with a hole formed diametrically within the sphere. The sphere with hole can be incorporated into a smoking article or tobacco product in accordance with one or more aspects of the invention.

The embodiment in FIG. 31 shows a sphere 3110 with a hole 3120 that runs fully or partially through the sphere. The sphere may include a magnetic or nonmagnetic material. The hole can be hollow or can be filled or partially filled with a magnetic or nonmagnetic material. The hole may run fully or partially through the sphere.

Figure 32:
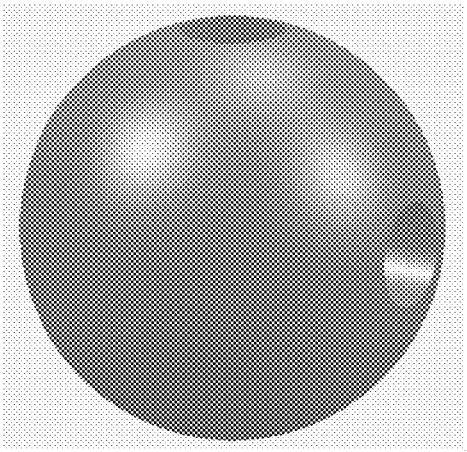
FIG. 32 is a schematic identifying a magnetizable material formed into a sphere with two holes formed diametrically within the sphere at approximately 90 degree angles to on another. The sphere with holes that can be incorporated into a smoking article or tobacco product in accordance with one or more aspects of the invention.

The embodiment in FIG. 32 is similar to FIG. 31 except that it has more than one hole that runs through a sphere.

Figure 33:
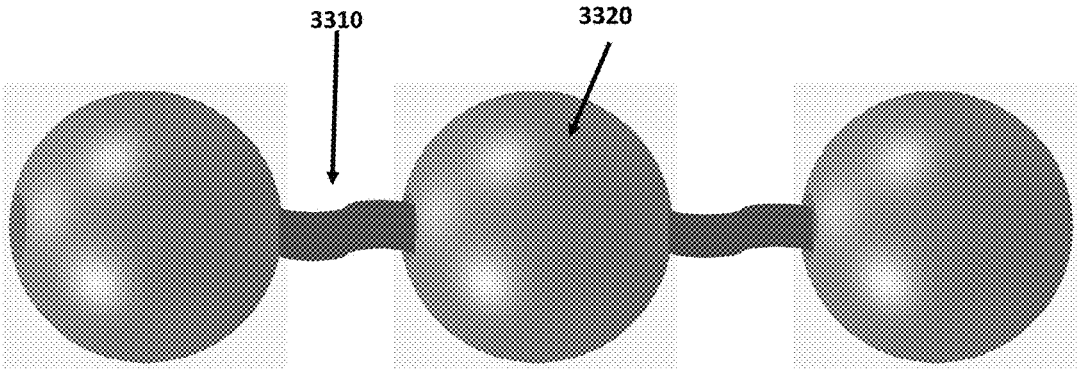
FIG. 33 is a schematic identifying three magnetizable spheres connected together with a flexible nonlinear element that can be incorporated into a smoking article or tobacco product in accordance with one or more aspects of the invention.

FIG. 33 shows a unique embodiment where two or more nonlinear magnetizable materials are joined together. The nonlinear object 3320 can be joined with another nonlinear object by a connector 3310. The at least one nonlinear object and/or connector can be made of a magnetizable material for the purpose of magnetic reclamation. The connector may or may not be adhered or fastened to the nonlinear object. The connector may be flexible and made of a magnetizable or non-magnetizable material. The embodiment in FIG. 33 is can be incorporated to a cigarette element or smokeless tobacco pouch at time of production. The embodiment can be fed into the production process through continuous advancement techniques with the use of a spool and feeder. Alternatively, the embodiment in FIG. 33 can be fed into a tobacco product through discrete placement techniques. The connector 3310 is, for example, flexible to allow the embodiment to conform with a cigarette filter element or smokeless tobacco pouch. It would not be difficult for one skilled in the art of tobacco product manufacturing or beaded wire manufacturing to produce and install such an embodiment. One or more elements of the FIG. 33 embodiment may be coated or treated with one or more materials.

Figure 34:
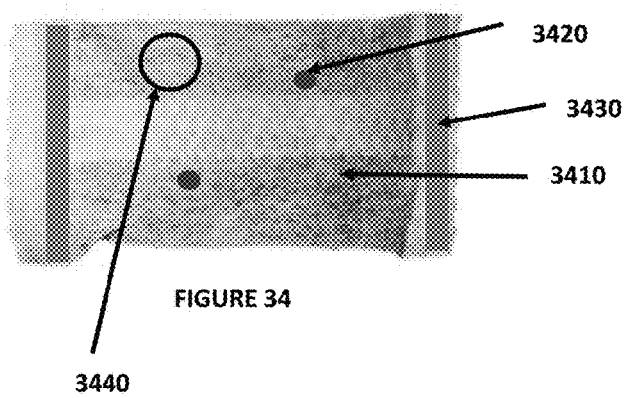
FIG. 34 is a schematic identifying multiple magnetizable materials in the shape of a ring, bead, and ribbon incorporated to a smokeless tobacco pouch in accordance with one or more aspects of the invention.

FIG. 34 shows a smokeless tobacco pouch 3410 with one or more magnetizable material embodiments. The smokeless tobacco pouch shows a magnetizable material embodiment incorporated within or on the walls of the tobacco article. For example, one or more magnetizable nonlinear beads 3420 can be placed within the pouch. Furthermore, one or more disks or rings 3440 of magnetizable material can be incorporated to the encapsulating walls of the smokeless tobacco pouch. Moreover, nonlinear magnetizable wire or ribbon 3430 can be incorporated to the pouch at or near the seams of the encapsulating pouch material. The magnetizable material embodiment can be incorporated to a smokeless tobacco pouch through a plurality of methods including adhering, sewing, fastening to and placing within the pouch.

Furthermore, the magnetizable material would be tasteless, food safe and hypoallergenic. Additionally, it is conceivable that a plurality of shapes can be incorporated to a smokeless tobacco pouch such that the shape incorporates a flexible and magnetizable material embodiment.

Figure 35:
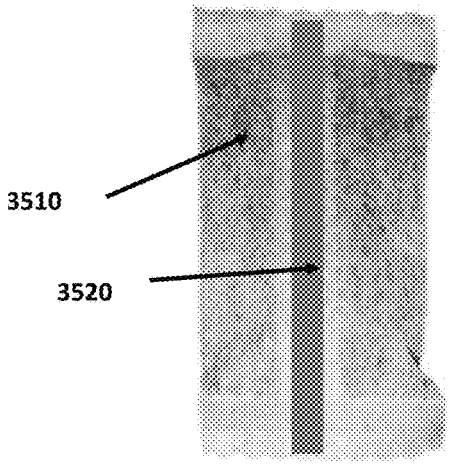
FIG. 35 is a schematic identifying magnetizable ribbon incorporated into a smokeless tobacco pouch in accordance with one or more aspects of the invention.

FIG. 35 is similar to FIG. 34 except the magnetizable material 3520 runs along the longitudinal axis of the smokeless tobacco pouch 3510 rather than the transverse axis.

Figure 36:
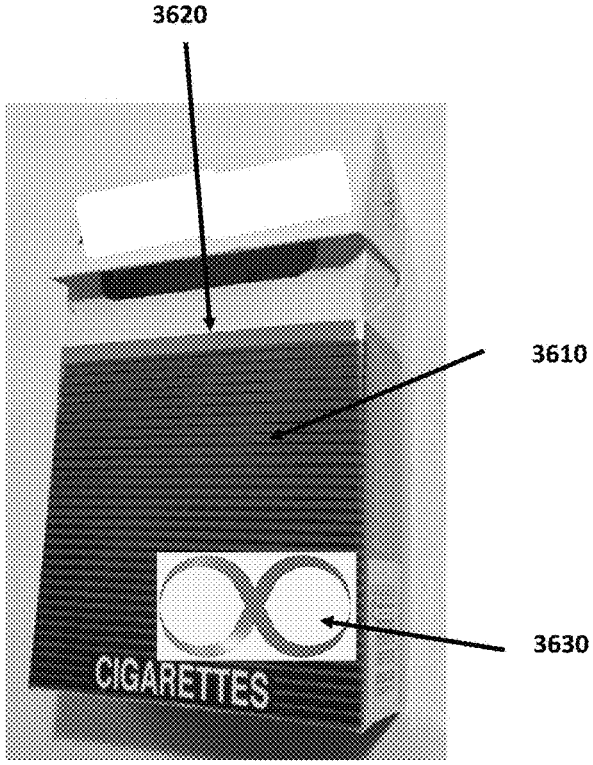
FIG. 36 is a schematic of a nonlinear magnetizable ribbon and a nonlinear magnetizable foil incorporated to a cigarette package in accordance with one or more aspects of the invention.

FIG. 36 shows a tobacco product package 3610 with at least one nonlinear magnetizable material incorporated therein. A nonlinear magnetizable material 3630 is incorporated to the package that holds the cigarettes after the package has been opened. Furthermore, a nonlinear magnetizable material cellophane pull tab 3620 is incorporated to the cellophane wrapping that is pulled off when the consumer opens the cigarette package so all portions of tobacco packaging may be magnetically retrieved.

Figure 37:
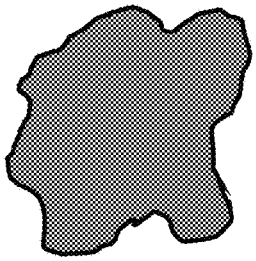
FIG. 37 is an amorphous nonlinear shape of magnetizable material that can be incorporated into a smoking article or tobacco product in accordance with one or more aspects of the invention.

FIG. 37 shows an amorphous nonlinear magnetizable material. This amorphous nonlinear magnetizable material can be incorporated to, in, or on a tobacco product for magnetic reclamation.

Figure 38:
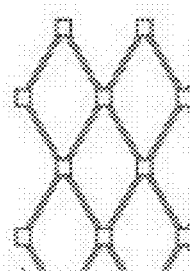
FIG. 38 is a magnetizable nonlinear mesh that can be incorporated into a smoking article or tobacco product in accordance with one or more aspects of the invention.

FIG. 38 shows two or more wires woven together to form a mesh pattern. This magnetizable mesh would be advantageous in allowing the nonlinear magnetic filter element to conform to a smoking article element, allow gas to flow through, remain flexible, adhere to filter fallout, act as a filtration mechanism, and allow for magnetic reclamation of a littered smoking article. This mesh may also be used to encapsulate or reside within a smokeless tobacco pouch.

Figure 41:
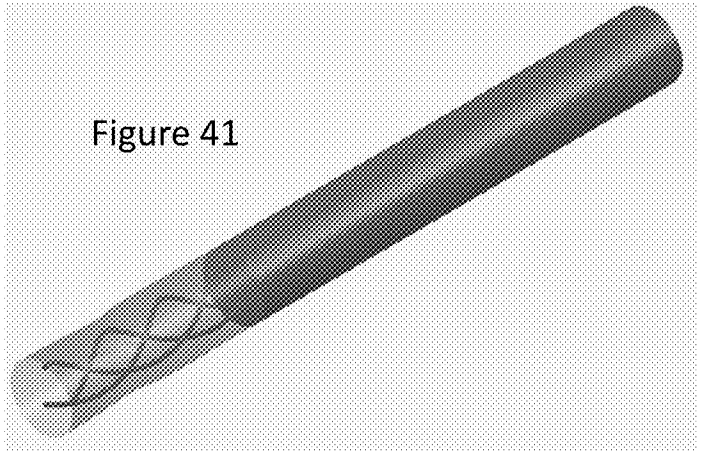
FIGS. 41 to 44 illustrate nonlimiting examples of flexible nonlinear magnetic filter elements in various shapes that are incorporated to a cigarette filter in accordance with one or more aspects of the invention.
Figure 42:
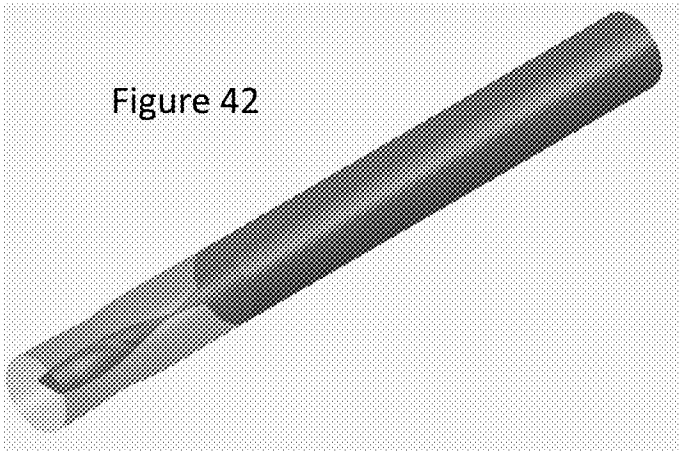
Figure 43:
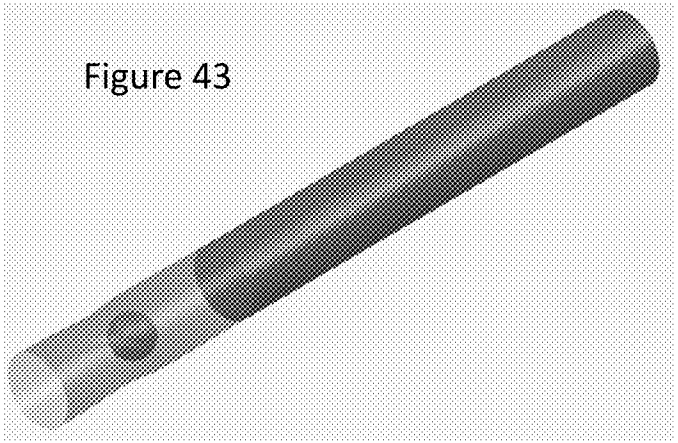
Figure 44:
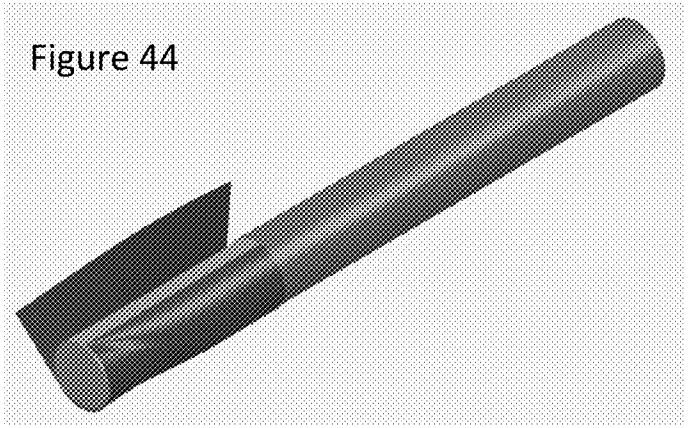

FIG. 41 shows, for example, a nonlimiting way, one or more flexible nonlinear magnetic filter elements in the shape of a wire are incorporated to a cigarette filter. This particular drawing shows three flexible nonlinear magnetic filter element wires. The one or more wires can be incorporated to a cigarette filter by the method of continuous advancement placement. It may be understood for one skilled in the art of the manufacture of cigarette filters to discern the best way to incorporate said flexible nonlinear magnetic filter element in the shape of a wire to a smoking article. FIG. 42 shows, by way of example, a nonlimiting way, one or more flexible nonlinear magnetic filter elements in the shape of a foil is incorporated to a smoking article. FIG. 43 shows, for instance, a nonlimiting way, one or more nonlinear magnetic filter elements, e.g., in the shape of a spheroid, are incorporated to a smoking article. FIG. 44 shows, for example, a nonlimiting way, one or more flexible nonlinear magnetic filter elements, e.g., in the shape of a foil, that are wrapped around a cigarette filter. The magnetic foil may be coated and can be incorporated to one side or more sides of another layer (e.g., paper) by way of adhesive, spraying, or the like. A magnetic filter element may also be the sole wrap around a cellulose acetate cigarette filter.

These embodiments of nonlinear flexible magnetizable objects in FIGS. 1 to 38 and 41 to 44 exemplify the invention disclosed herein that proposes orientation-independence of magnetic retrieval. The key attribute of each of these embodiments is the range of orientations available for interaction with a magnetic field. The ribbon-variant of these configurations is particularly attractive in most cases because of the intrinsic anisotropy of the magnetic response of a thin planar surface.

The foregoing disclosure has been set forth merely to illustrate the embodiments and is not intended to be limiting. Since modifications of the disclosed embodiments incorporating the spirit and substance of the invention may occur to persons skilled in the art, the invention should be construed to include everything within the scope of the appended claims and equivalents thereof. Although the disclosure uses terminology and acronyms that may not be familiar to the layperson, those skilled in the art will be familiar with the terminology and acronyms used herein. Furthermore, it is understood that the present embodiments can be incorporated to a plurality of other apparatus for the purpose of magnetic retrieval.

A portion of the disclosure of this patent document contains material which is subject to copyright protection. The copyright owner has no objection to the facsimile reproduction by anyone of the patent document or the patent disclosure, as it appears in the US Patent and Trademark Office patent file or records, but otherwise reserves all copyright rights whatsoever.

It is of utmost importance that the disclosed invention becomes commercialized and incorporated to as many cigarettes and smokeless tobacco pouches as soon as possible because the toxins released from tobacco products into the environment are seriously affecting the Earth's ecosystem . . . and will only get worse if nothing is done about it.

Other objects, advantages and novel features of the present invention will become apparent from the following detailed description of one or more embodiments when considered in conjunction with the accompanying drawings.

What is claimed is:

1. A nonlinear magnetizable object, wherein:

the object has a nonlinear shape and is magnetizable, the object is comprised of a material that is flexible, and the object is incorporated into a disposable tobacco article configured such that the object is reclaimable from an environment, wherein the nonlinear shape is a three-dimensional shape that is solid or hollow, and material is contained inside the three-dimensional shape that is releasable when force is applied.

2. The nonlinear magnetizable object according to claim 1, wherein the object is a wire, a foil, or a ribbon.

3. The nonlinear magnetizable object according to claim 2, wherein the foil or ribbon is twisted.

4. The nonlinear magnetizable object according to claim 1, wherein the nonlinear shape is a sphere.

5. The nonlinear magnetizable object according to claim 1, wherein the object comprises a mesh of wires or ribbon with a plurality of rings attached via corrugated wires or ribbon.

6. The nonlinear magnetizable object according to claim 1, wherein the material of the object is magnetizable and is engineered to: (i) reduce magnetic coercivity, (ii) increase magnetic permeability, and (iii) saturation flux density.

7. The nonlinear magnetizable object according to claim 1, wherein the object includes at least one adhesive, treatment, or coating.

8. The nonlinear magnetizable object according to claim 1, comprising at least one coating partially or wholly coating the object.

9. The nonlinear magnetizable object according to claim 1, wherein the object is incorporated into the disposable tobacco article via a continuous feeding method, sprayed on, or a discrete placement method.

10. A tobacco related product comprising:

a nonlinear magnetizable object of magnetizable material incorporated into the tobacco related product such that the tobacco related product is retrievable from an environment; and another material proximate the object, distinct therefrom, and secured thereto to be recovered therewith;

wherein the object comprises a mesh of wires or ribbon with a plurality of rings attached via corrugated wires or ribbon.

11. The tobacco related product according to claim 10 wherein the nonlinear magnetizable object is a wire, ribbon, or foil having a shape of a ring, a disk, a semicircle, or helix.

12. The tobacco related product according to claim 10 wherein the nonlinear magnetizable object is comprised of a material that is flexible.

13. The tobacco related product according to claim 10 wherein the nonlinear magnetizable object or the magnetizable material is hypoallergenic, food safe, and/or tasteless.

14. The tobacco related product in according to claim 10, wherein the tobacco related product is a cigarette filter, cigar tip, a smokeless tobacco pouch, or tobacco related packaging.

15. An object for retrieving a tobacco related article, wherein:

the object is in a nonlinear shape, magnetizable, flexible, and incorporated into a disposable tobacco article; and the object is selected from a wire, a foil, or a ribbon formed as two rings or disks attached at a single point along a circumference thereof so that the axes of each are misoriented with respect to one another by an angle ranging from 0 to 90 degrees.

16. The object of claim 15, wherein:

the object comprises a mesh of wires or ribbon with a plurality of rings attached via corrugated wires or ribbon;

the shape is three-dimensional, selected to be either solid or hollow; and a material is contained inside the three-dimensional shape to be releasable when force is applied thereto.

* * * * *